US005637960A

United States Patent [19]

Juengst et al.

[11] Patent Number: 5,637,960

[45] Date of Patent: Jun. 10, 1997

[54] CERAMIC DISCHARGE VESSEL FOR A HIGH-PRESSURE DISCHARGE LAMP, HAVING A FILLING BORE SEALED WITH A PLUG, AND METHOD OF ITS MANUFACTURE

[75] Inventors: Stefan Juengst, Zorneding; Roland Huettinger, Jesenwang; Jens Clark, Ebersberg, all of Germany; Osamu Asano, Hashima; Kouichiro Maekawa, Ichinomiya, both of Japan

[73] Assignees: Patent-Treuhand-Gesellschaft für elektrische Glühlampen mbH, Munich, Germany; NGK Insulators Ltd., Nagoya, Japan

[21] Appl. No.: 491,874

[22] PCT Filed: Feb. 4, 1994

[86] PCT No.: PCT/EP94/00324

§ 371 Date: Jul. 11, 1995

§ 102(e) Date: Jul. 11, 1995

[87] PCT Pub. No.: WO94/18693

PCT Pub. Date: Aug. 18, 1994

[30] Foreign Application Priority Data

Feb. 5, 1993 [DE] Germany ..... 93 101 831.1

[51] Int. Cl.[6] ..... H01J 61/36; H01J 9/32; H01J 61/82

[52] U.S. Cl. ..... 313/625; 313/623; 313/624; 445/44

[58] Field of Search ..... 313/623, 624, 313/625; 445/16, 38, 40, 44, 56, 73

[56] References Cited

U.S. PATENT DOCUMENTS

| | | | |
|---|---|---|---|
| 3,132,279 | 5/1964 | Lewin | 313/623 |
| 4,122,042 | 10/1978 | Meden-Piesslinger et al. | 313/220 |
| 4,277,715 | 7/1981 | Claassens et al. | 313/220 |
| 4,475,061 | 10/1984 | van de Weijer et al. | 313/623 |
| 4,545,799 | 10/1985 | Rhodes et al. | 313/623 |
| 5,352,952 | 10/1994 | Juengst | 313/625 |
| 5,404,078 | 4/1995 | Bunk et al. | 313/625 |
| 5,446,341 | 8/1995 | Hofmann et al. | 313/623 |
| 5,484,315 | 2/1996 | Juengst et al. | 445/26 |

FOREIGN PATENT DOCUMENTS

| | | |
|---|---|---|
| A 0 052 844 | 6/1982 | European Pat. Off. . |
| A 0 060 582 | 9/1982 | European Pat. Off. . |
| 0 136 505 B1 | 4/1985 | European Pat. Off. . |
| A 0 272 930 | 6/1988 | European Pat. Off. . |
| 0 472 100 A2 | 2/1992 | European Pat. Off. . |
| A 0 528 428 | 2/1993 | European Pat. Off. . |
| 91 12 690 | 1/1992 | Germany . |
| A 62-123 647 | 6/1987 | Japan . |
| A 63-143738 | 6/1988 | Japan . |

*Primary Examiner*—Sandra L. O'Shea
*Assistant Examiner*—Jay M. Patidar
*Attorney, Agent, or Firm*—Frishauf, Holtz, Goodman, Langer & Chick, P.C.

[57] ABSTRACT

To provide a tight seal for a fill bore in the wall or an end plug of a discharge vessel for high-pressure discharge lamps, a fill bore is provided either through the wall—in the region of the plug—or through a plug, and the fill bore is then closed by a stopper in combination with a melt sealing material, which is so chosen that the sealing material and plug-like member combination provide a minimum of sealing material exposed to the fill in the discharge volume. The fill in the discharge volume of the discharge vessel is ionizable and, for example containing halides, is highly corrosive to the sealing material. The lamp can be made by inserting a stopper into the filling bore, applying, with the stopper in place in the filling bore, sealing material to the outer end of the filling bore, and heating the portion of the discharge vessel to liquefying temperature of the sealing material to liquefy the sealing material and hence close off the fill bore.

21 Claims, 5 Drawing Sheets

CERAMIC DISCHARGE VESSEL FOR A HIGH-PRESSURE DISCHARGE LAMP, HAVING A FILLING BORE SEALED WITH A PLUG, AND METHOD OF ITS MANUFACTURE

This application is copending to the European patent application no.: 93 101 831.1, Heider et al., to which U.S. application Ser. No. 08/146,969 and Continuation application Ser. No. 08/553,827, now U.S. Pat. No. 5,592,049, Jan. 7, 1997, correspond.

FIELD OF THE INVENTION

The invention relates to a high-pressure discharge lamp and a method of its manufacture and, more particularly, to a ceramic discharge vessel and a current feedthrough therefor.

BACKGROUND

High-pressure discharge lamps may be high-pressure sodium discharge lamps, and, more specifically, metal halide lamps having improved color rendition. The use of a ceramic discharge vessel for the lamps enables the use of the higher temperatures required for such vessels. The lamps have typical power ratings of between 50 W–250 W. The tubular ends of the discharge vessel are closed by cylindrical ceramic end plugs comprising a metallic current feedthrough passing through the axial hole therein.

Customarily, these current feedthroughs are made of niobium tubes or pins (see U.S. Pat. No. 5,852,952, Juengst et al.). However, they are only partly suitable for lamps that are intended for a long useful life. This is due to the strong corrosion of the niobium material and, possibly, the ceramic material used for sealing the feedthrough into the plug when the lamp has a metal halide fill. An improvement is described in U.S. Pat. No. 4,545,799, to which the European Patent Specification EP-PS 136 505 corresponds. A niobium tube is tightly sealed into the plug by the shrinking process of the "green" ceramic during the final sintering without ceramic sealing material. This is readily possible because both materials have approximately the same thermal expansion coefficient ($8\times10^{-6}$ $K^{-1}$).

Although metals such as niobium and tantalum have thermal expansion coefficients that match those of the ceramic, they are known for having poor corrosion resistance against aggressive fills and they have not yet been available for use as a current feedthrough for metal halide lamps.

Metals such as molybdenum, tungsten and rhenium have a high corrosion resistance against aggressive fills, but a low thermal expansion coefficient. Their use as a current feedthrough is, therefore, highly desirable. However, the problem of providing a gas-tight seal while using such feedthroughs has remained unsolved in the past.

It has already been attempted to use a molybdenum tube as a feedthrough, see U.S. Pat. No. 5,404,078, Bunk, et al. In order to avoid the use of ceramic sealing material which can be corroded by aggressive fill materials, the tube is gas-tightly sintered directly into the plug without any sealing material. This has to be done by a special manufacturing method.

Reference to the contents of U.S. Pat. No. 5,404,078, Bunk et al. is expressly made, especially to the manufacturing method and to the composition of the plug material.

The use of a solid molybdenum pin as a feedthrough in connection with a ceramic vessel and plug, made from alumina, has also been discussed in the past. However, the gas-tightness between the plug and the pin is obtained by using a rather corrosion resistant sealing material (glass melt or ceramic melt) or frit which is filled into the gap between the hole of the plug and the feedthrough (see for example U.S. Pat. No. 4,277,715). Preferably, pin diameters below 600 μm are used.

A detailed discussion of this technique is given in the U.S. Pat. No. 4,475,061.

From DE-A 23 07 191, to which Canadian 964,323 corresponds, and U.S. Pat. No. 4,122,042, a metal halide lamp is known which has a ceramic vessel with an electrically conductive plug made from a cermet consisting of alumina and molybdenum metal. A feedthrough of molybdenum is directly sintered into the plug.

The PCT/DE 92/00372, issued in the U.S. as U.S. Pat. No. 5,484,315, Juengst et al., describes a special filling technique for such lamps using a separate filling bore in the plug for evacuating and filling the discharge vessel. The bore is closed off after filling by means of sealing material, i.e. glass melt or ceramic melt, which, however, is in full contact with the constituents or components of the fill and, unfortunately, tends to react with these components of the fill.

THE INVENTION

It is an object of the invention to provide a ceramic discharge vessel (and a related filling technique) which is capable of resisting corrosion and remains tight under changes of temperature and which can be used, more particularly, for ceramic vessels having a metal halide containing fill, and to provide a method of making how these vessels and, more particularly, to closing a filling bore of the vessel.

Briefly, a discharge vessel, which defines a discharge volume and retains an ionizable fill, has two ends which are closed off by plugs which are sintered directly into the vessel to gas-tightly close off the ends. The vessel, or a plug, is formed with a small filling bore to permit evacuating the discharge volume and/or filling the interior of the vessel with the ionizable fill. The combination of a plug-like member or stopper and sealing material, together, then sealingly close the filling bore after the fill has been introduced into the vessel. The sealing material and plug-like member and stopper are so arranged in the combination that only a minimum of sealing material is in contact with the fill in the discharge volume.

Lamps with such vessels have a good long-time gas-tightness and a good maintenance because the contact between the sealing material or frit and the aggressive fill is reduced to a rather low level.

It is an important feature of the invention that the plug members are sintered directly into the vessel ends. Thus, no sealing material (or only a very small amount of it) is in contact with the discharge volume. To achieve this requirement, the plugs can even be integral parts of the vessel ends. Any other technique, which relates to the sealing of the plugs and dramatically reduces the amount of sealing material which is in contact with the discharge volume, may be equivalent to the direct sintering technique.

The specific features of the plug and/or the current feedthrough are of minor importance; rather sealing material or frit which is in direct contact with the discharge volume is minimized.

For example, the plug may be made from an electrically conducting cermet, as discussed, for instance, in FIG. 9 of U.S. Pat. No. 5,484,815, Juengst et al. Here, a separate feedthrough can be dispensed with.

The plug may be made from a non-conductive material such as alumina ceramic or from a non-conductive cermet (composite material) as described in U.S. Pat. No. 5,404,078, Bunk et al., to which the European Patent Application 528 428 corresponds, where a metallic feedthrough extending through the plug is used. Preferably the feedthrough is arranged in the plug in such a way that no sealing material or frit is in contact with the discharge volume. Direct sintering of a molybdenum feedthrough, which may be a tube or, particularly preferably, a rod or pin, is preferred. Other materials such as tungsten or rhenium may also be used. They have a thermal expansion coefficient between 4 and $7\times10^{-6}$ $K^{-1}$ which is similar to that of molybdenum. A system using two plugs which are directly sintered into the vessel ends and two molybdenum pins directly sintered into the plugs is especially advantageous.

In the manufacture of the lamp, the first end of the discharge vessel, which is the blind end, is gas-tightly closed. The second end, that is the end through which the fill is introduced, however, is provided with a small filling bore. The fill may include halogen-containing components. The filling bore may be located in the wall of the vessel end close to the plug to avoid direct contact with the condensed components of the fill. In another embodiment, the bore may be provided in the plug itself, for instance, as an eccentric hole near the feedthrough which is frequently arranged in an axial bore. The temperature of the plug region is lower than the temperature of the wall of the discharge vessel, and chemical reaction between the sealing material and the components of the fill is retarded. Heretofore, the filling bore was closed with sealing material alone. The disadvantages are as follows: the quantity of the required glass sealing material is relatively large; the capillary forces are not very strong when a rather "large" hole or gap has to be filled so that the sealing process takes long and cannot readily be reproduced; the sealing material solidifies inhomogeneously and becomes subject to the formation of cracks therein since during cooling of the sealing material the temperatures in the middle of the hole or gap are higher than at the outside of the hole; the reaction of the components of the fill with the glass sealing material is intensified as a result of the larger quantities of sealing material.

In accordance with a feature of the invention, a stopper is used which fits into the filling bore. There are several advantages in this. The dimensions of the bore can be made larger so that the filling procedure will be simplified. Moreover, the amount of sealing material in the filling bore which is in contact with the discharge volume and which thus may be in contact with the components of the fill and has heretofore been critical is now drastically reduced. The most astonishing fact is that this improvement is sufficient to remarkably extend lifetime and maintenance of the lamps. The reason for this is that the area of the filling bore is the sole contact zone or area between the sealing material which is subject to corrosion, and the discharge volume. The stopper reduces this contact area by more than 50% and provides a base for further specific improvement. Moreover, the sealing process is greatly facilitated, the solidification of the sealing material and hence its sealing characteristics are improved, and reactions with the fill are reduced. Preferably, the length of the stopper is shorter than the length of the filling bore in order to shift the contact zone between sealing material and fill components where a chemical reaction can take place from the hot inner surface of the wall of the discharge vessel to the cooler region inside the bore.

This is of major importance when the fill bore, rather than in the wall of the discharge vessel, is located in the plug itself because the thickness of the plug and, therefore, the temperature gradient resulting from the length difference between stopper and bore is much higher than that of the wall of the discharge vessel.

In such an embodiment the sealing material adheres to the stopper fitting only into a part of the bore, and therefore stays well inside the bore. The difference in length is preferably larger than 20%. The lower temperature of the contact area which has thus been obtained results in a reduced reaction between sealing material and fill components. This leads to better maintenance of the luminous flux and of the color rendering index.

The stopper has at least a main part which fits into the filling bore. The bore and the main part of the stopper generally both have circular cross-section, and the diameter of the stopper is slightly smaller, preferably 2%–10% smaller, than the diameter of the bore.

Preferably the materials of the plug and of the stopper are ceramic-like and do not differ substantially; their coefficients of thermal expansion are equal or only slightly different, with the coefficient of thermal expansion of the stopper being higher. Alumina or a composite material having alumina as its main component are preferred materials. In a preferred embodiment, the stopper is made from alumina and the plug is made from a cermet-like composite material made from alumina as a main component and a second material having a lower coefficient of thermal expansion (preferably, tungsten or molybdenum). The effect of this construction is that the plug is under a compressive strain after the sealing process. The stopper, in contrast, is under a tensile strain. The stability of ceramic-like materials against compressive strain is greater than against tensile strain, which is of more importance for the rather fragile (cermet) plug than for the comparatively compact stopper. As a result of this, the seal remains tight over a longer time.

To render closing of the bore more easy, the stopper is preferably provided with an extension part which has at least one cross dimension that is larger than the diameter of the bore. Thus, insertion of this extension part into the bore is not possible, and the stopper can hold itself in the bore before the sealing material is applied.

In a first embodiment, this extension part is formed like a knob. It may, for example, be a second cylindrical part having a diameter larger than the main part and, naturally, larger also than the filling bore. Thus the stopper as a whole consists of two pin-like parts with different diameters.

In a second embodiment, the extension part basically has the same diameter as the main part but it has a squeezed or flattened part, the squeezed or flattened portion being formed when the stopper, which is made, for example, from ceramic, is still in its "green" state.

It is of special advantage to carefully choose the length of the extension part so that it can be of assistance during the final sealing procedure. This can be understood as follows: the discharge vessel, generally, is a tube with two ends which are both closed by plugs, to which the respective electrode systems have already been attached, which are inserted into the vessel ends in their green state and are then sintered together with the green vessel to result in a gas-tightly sintered body. One of the plugs, or the vessel itself, is provided with a filling bore through which the discharge volume can be evacuated and then filled with metal (mercury) and metal halides and, optionally, with inert gas, especially within a glove box with an inert gas atmosphere (for example, argon at normal pressure). In order to close off the end with the filling bore therein, the stopper is inserted into the filling bore, and a ring of glass sealing material or ceramic sealing material is applied around the stopper at the surface of the plug outside the discharge vessel. Before executing further steps, a weight is placed on the discharge vessel which is arranged in a vertical position so that the second end of the discharge vessel is the upper end. The weight preferably has an axial opening into which the outer end of the feedthrough or current lead connected to the plug fits. The weight presses against the upper end of the long extension part of the stopper and counteracts the outwardly directed pressure of further filling and closing steps.

If an inert gas with low pressure (below 1 bar) is to be introduced as a filling atmosphere in the vessel, a separate part or chamber of the glove box is evacuated, while the vessel is positioned in this chamber, until the low pressure is reached. Evacuation of the vessel through the narrow gap between bore and stopper takes more time than evacuation of the chamber itself and generates for the first time an outwardly directed pressure.

Then the ring of sealing material is heated together with the end portion of the vessel or, more customarily, the whole discharge vessel, until it is liquefied and runs into the gaps occurring between the wall of the filling bore and the stopper.

To ensure that the liquid frit provides for good wetting of the parts surrounding the gap and to ensure that the gap is perfectly filled with the frit, the heating process has to be continued for some time. This leads to an increase of the fill pressure inside the vessel which tends to press the stopper and the liquefied sealing material or frit out of the bore, that is, out of the vessel.

Whereas it is possible to counteract this effect of outwardly directed pressure by costly or time-consuming measures (see for example U.S. Pat. No. 5,446,341) such as, for instance, increasing the pressure on the outside of the vessel which requires careful observation and control, the concept of a stopper, preferably with a long extension part which permits to be held in position by a weight, provides a very simple solution for dealing with this problem, which arises once or optionally twice. The stopper is held inside the bore and, as a consequence, capillary forces also retain the liquefied sealing material in the small gap between the stopper and the wall of the filling bore. Thus, the whole arrangement withstands the increased pressure.

The length of the extension part is preferably far larger (for example, more than three times as large) than the thickness of the not yet liquefied sealing material because, otherwise, the liquefied sealing material would contact the weight and connect it to the vessel end by creeping along the extension part and/or current lead owing to its good wettability characteristics.

The end region of the filling bore, at the outer surface of the plug, can be provided with an increased diameter compared with the remaining part of the bore, like a funnel. This simplifies insertion of solid and/or liquid constituents and, later on, of the stopper into the bore.

All factors considered, the concept of a filling bore and a stopper for closing it as herein described is the best realisation of a lamp in which a sealing material in contact with the discharge volume and the fill retained therein is avoided as much as possible.

The two feedthroughs preferably are both pin-like; however, one may also be pin-like and the other tube-like; or, they may be substituted by electrically conductive cermet plugs. The copending application Heider et al., to which U.S. patent application Ser. No. 08/146,969 and Continuation application Ser. No. 08/553,827, now U.S. Pat. No. 5,592,049, Jan. 7, 1997, correspond describes further details of such lamps, for example, a composition of a sealing material which is well suited and a preferred composition of the plug material.

The invention will now be more closely described by way of several practical examples.

FIG. 1 shows a metal halide lamp having a ceramic discharge vessel;

FIG. 1*a* is an enlarged view of a detail within a circle of FIG. 1;

FIG. 2 shows another embodiment of the filling end of a discharge vessel;

FIGS. 3*a*, 3*b* and 3*c* show a sequential step for another embodiment of the filling and closing procedure;

DETAILED DESCRIPTION

Figure 1:
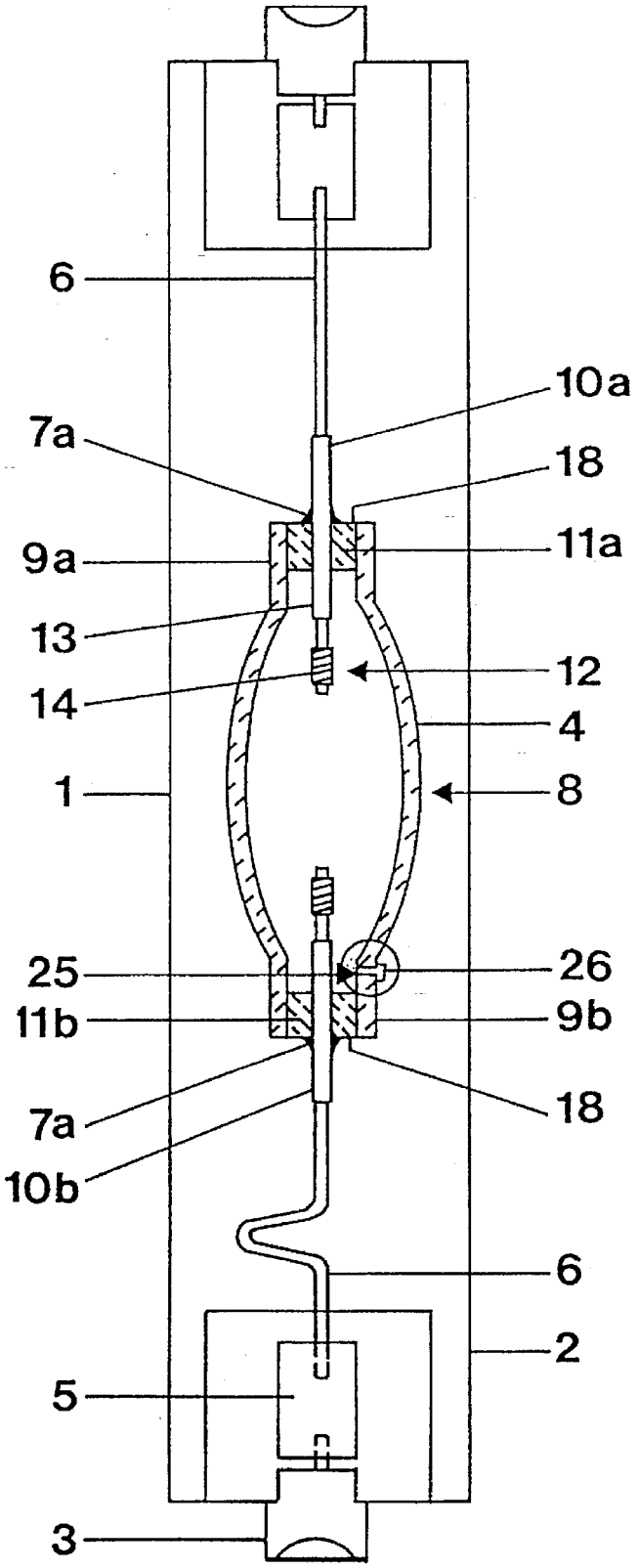

FIG. 1 shows, schematically, a metal halide discharge lamp having a power rating of 150 W. It includes a cylindrical outer envelope 1 of quartz glass or hard glass defining a lamp axis. The outer envelope is pinch-sealed at 2 on both sides and supplied with bases 3. The axially aligned discharge vessel 8 of alumina ceramic has a barrel-shaped middle portion 4 and cylindrical ends 9*a*, 9*b*, collectively 9. It is supported in the outer envelope 1 by means of two current supply leads 6 which are connected via foils 5 to the bases 3. The current supply leads 6 are welded to pin-like current feedthroughs 10*a*, 10*b*, collectively 10 which are directly sintered into a central axial hole in the respective ceramic plugs 11 of composite material at the end of the discharge vessel.

The two solid current feedthroughs 10 of molybdenum each support an electrode system 12 on the side facing the discharge. The electrode system has an electrode shaft 13 and a coil 14 slipped onto the end of the electrode shaft on the side facing the discharge. The shaft of the electrode may be gas-tightly connected by a butt-weld to the end of the current feedthrough or, as shown, may act itself as the feedthrough. A pin-like feedthrough 10 of 300 μm diameter is used at both ends 9 of the discharge vessel 8.

The fill of the discharge vessel comprises, in addition to an inert starting gas such as, for example, argon, mercury and additives of metal halides. In another example the mercury component can be omitted. The cold filling pressure of the inert gas may be above or below 1 bar.

Both plugs 11*a*, 11*b*, collectively 11 are made from a composite material which is ceramic and electrically non-conductive and consists of 70% by weight of alumina and 30% tungsten. The thermal expansion coefficient of this material is about $6.5\times10^{-6}$ $K^{-1}$ and lies between the thermal expansion coefficents of pure alumina ($8.5\times10^{-6}$ $K^{-1}$) of the vessel 8 and of the molybdenum pin 10 ($5\times10^{-6}$ $K^{-1}$).

At the first end 9*a* of the vessel, which is the blind end, the first plug 11*a* is directly sintered into the end 9*a*. The gas-tightness is additionally accomplished by a sealing layer 7*a* covering the outer surface 18 of the first plug 11*a* in the vicinity of the feedthrough 10*a*.

The sealing material 7*a* may comprise as already known at least $Al_2O_3$, $SiO_2$, $La_2O_3$. $Y_2O_3$; $MoO_3$ and/or $WO_3$ may be added.

At the second end 9b of the vessel, which is the pump end, the second plug 11b is likewise directly sintered. Similar to the first plug, a sealing layer 7a covers the interface between the feedthrough 10b and the plug 11b at the surface 18 facing away from the discharge volume. In principle, any suitable sealing material can be used.

A filling bore 25 with a diameter of 1 mm is arranged separately in the wall of the vessel near the second end 9b thereof. Preferably, it is 1 mm or more away from the surface of the second plug 11b facing the discharge volume. The reason is that the aggressive metal halide fill components may tend to condense around the surface of the plug if the lamp is operated in vertical position. If there is any sealing material which is in contact with the discharge volume in this region, it can be attacked by these aggressive fill components.

Evacuating and filling is performed through the small filling bore 25 which is closed after filling.

Figure 1A:
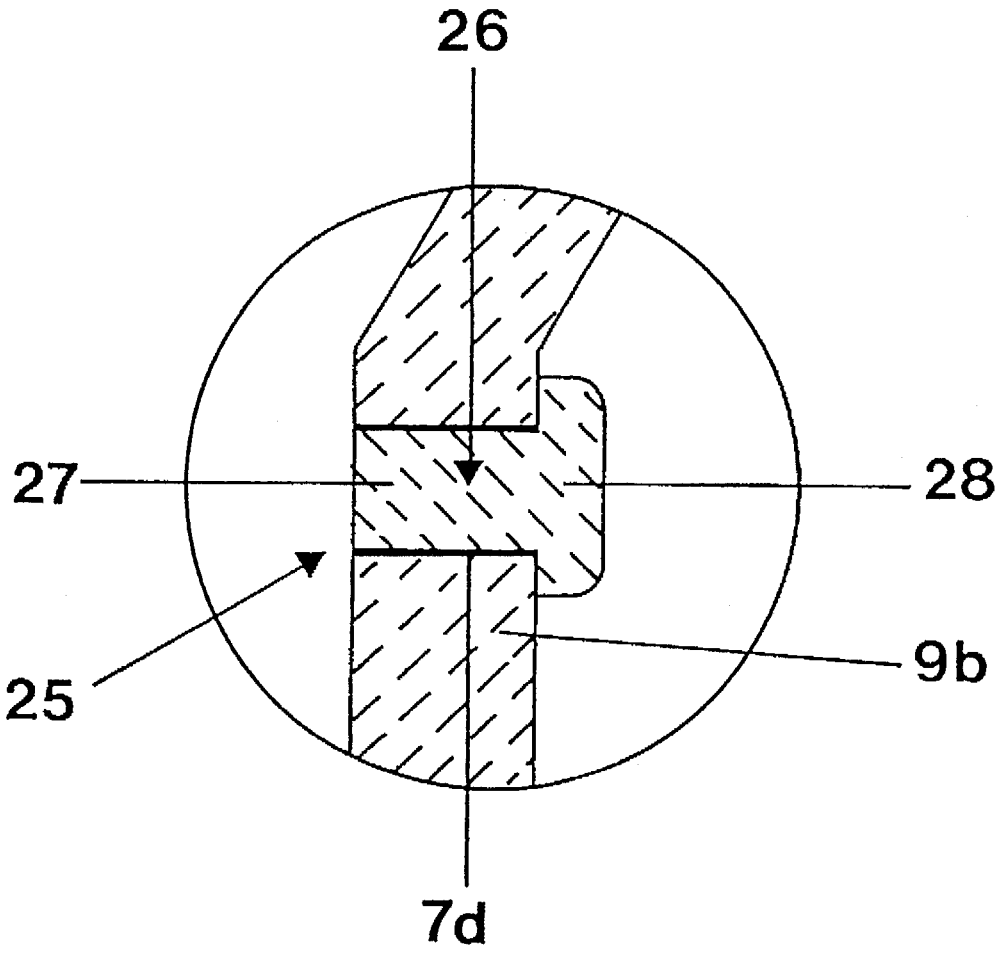

In accordance with a feature of the invention, the bore 25 is closed by inserting a small stopper 26 (see also the enlarged detail of FIG. 1a) made from a ceramic, which comprises substantially alumina, and sealing gastightly a gap between the bore 25 and the inserted plug-like stopper 26 with a sealing material 7d which may be the same as that used at the surface of the plugs. The main part 27 of the stopper terminates flush with the inside surface of the wall of the discharge vessel. The extension part 28 is knob-like and has a diameter larger than the filling bore 25 (about 1.5 mm). The closing may be accomplished by locally heating the second end or by heating the whole vessel, the stopper being held in position during this heating.

Figure 2:
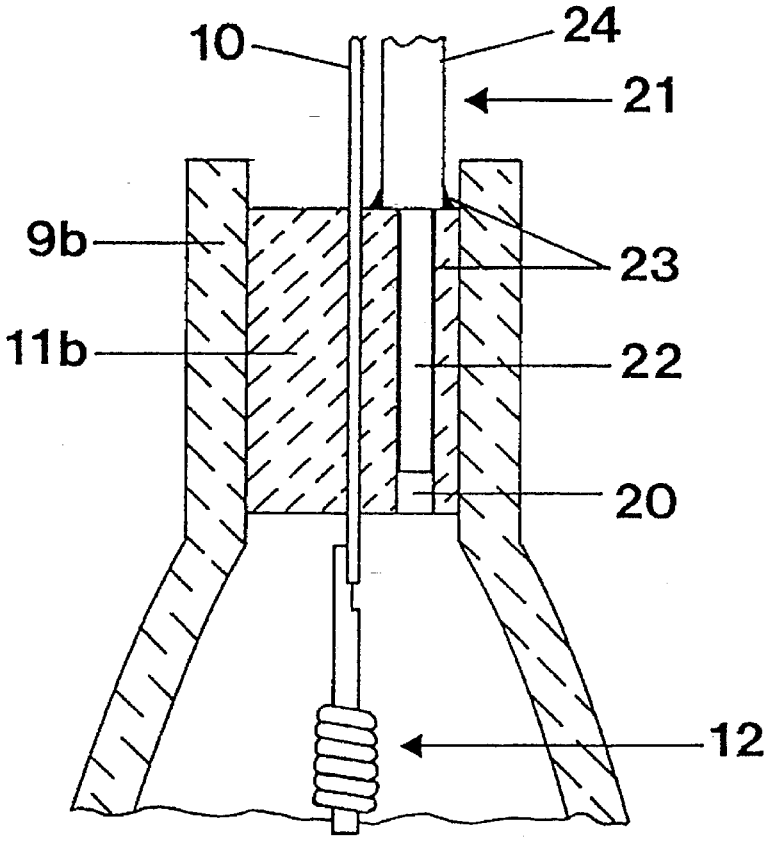

FIG. 2 shows, highly schematically, a further preferred embodiment. Only the region of the second vessel end 9b is shown in detail. The plug 11b itself, made from alumina, is provided with an eccentric filling bore 20 having a diameter of about 1.0 mm beside the axially aligned pin-like feedthrough 10 which is connected to the electrode system 12.

The stopper 21 has a cylindrical main part 22 which extends only over about 70% of the length of the filling bore 20. The gap between bore and stopper is filled with ceramic sealing material 23. The part of the bore 20 facing the discharge is free from this material. The extension part 24 of the stopper is again cylindrical but its diameter is larger than the bore diameter. Its length is comparable to that of the main part. The stopper 21 is also made from alumina.

Figure 3A:
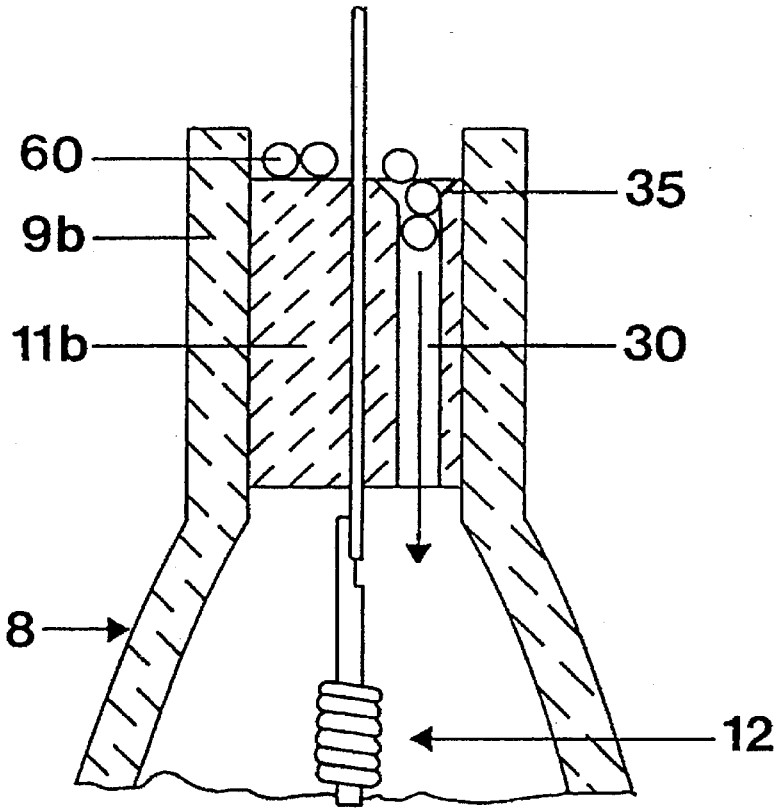
Figure 3C:
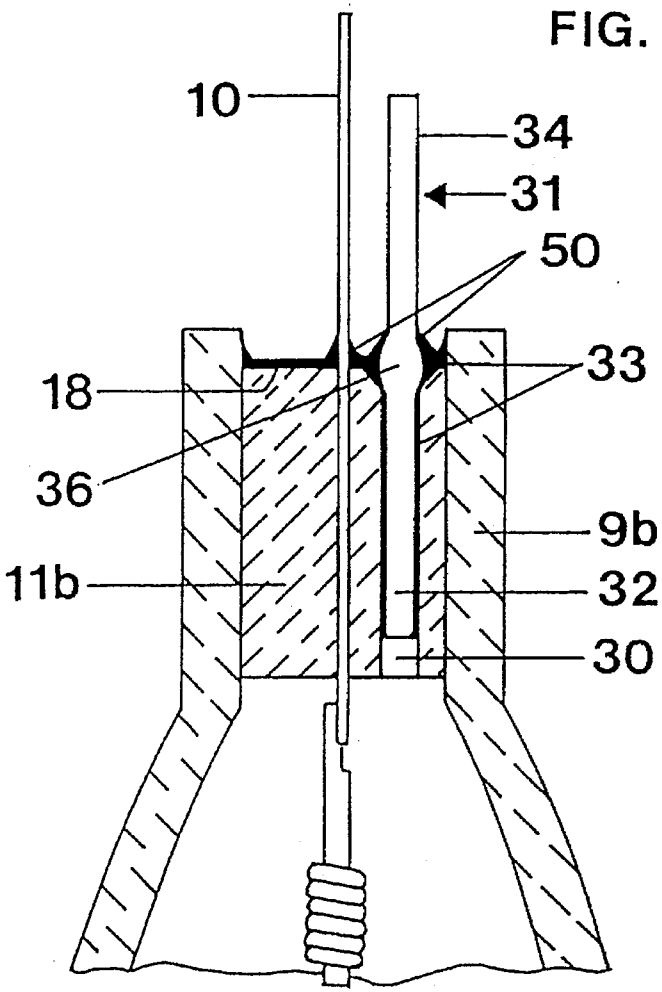
Figure 3B:
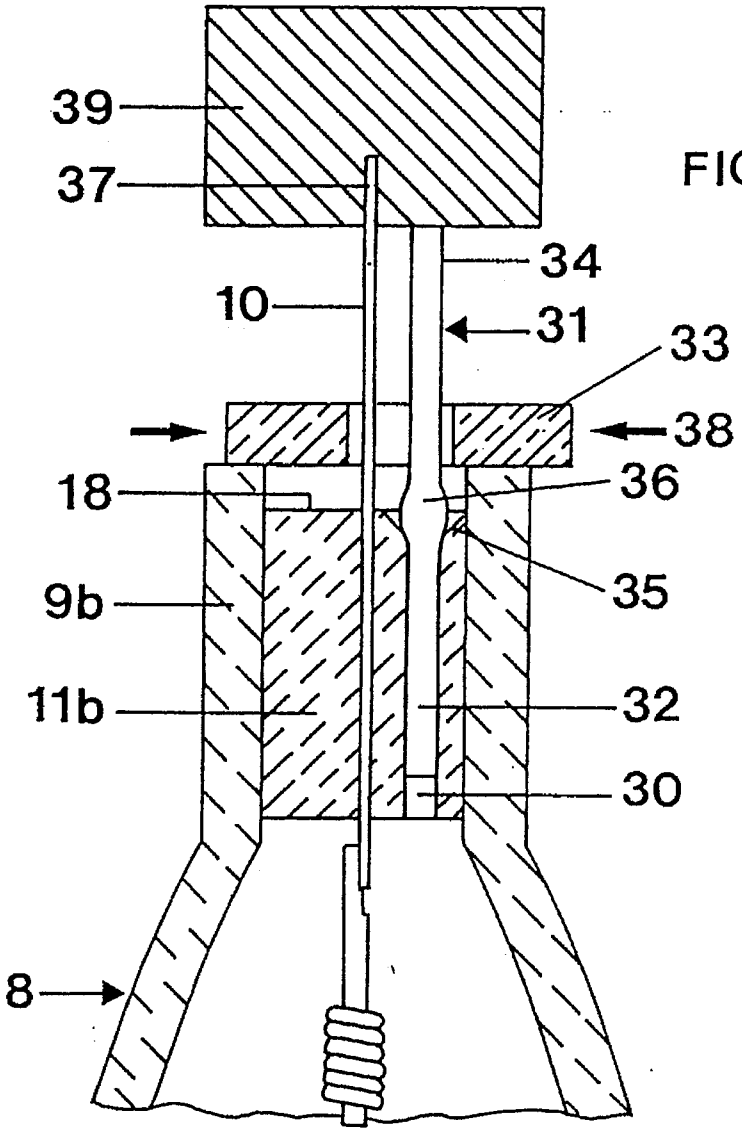
Figure 4:
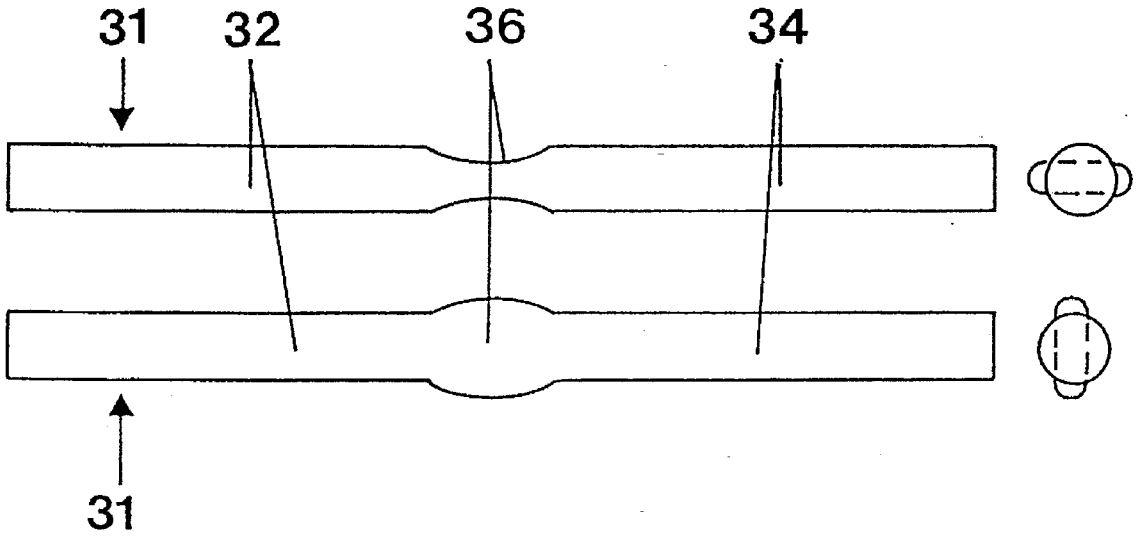
FIG. 4 shows an embodiment of the stopper in enlarged view.

FIG. 3, collectively, illustrates another embodiment, and the steps of filling and closing-off the discharge volume. Again the plug 11b is sintered directly into the second vessel end 9b. Whereas the vessel 8 is made from alumina, the plug 11b, by way of example, is made from an electrically non-conductive cermet (composite material with alumina as the main component of 70% thereof. The feedthrough-and-electrode system 12 is similar to that of FIG. 2. The filling bore 30 again is arranged in the plug 11b; its diameter is 0.70 mm. The outer part 35 of the bore is funnel-shaped, the diameter increasing to 1.2 mm. In this embodiment, the vessel end 9b is slightly longer (by about 0.5 mm) than the plug 11b (FIG. 3a). Thus, it serves as a barrier for the solid and/or liquid fill constituents, for example mercury and tiny pills 60 made from metal halides. They are prevented from falling beneath the vessel instead of passing the funnel 35 and the rest of the bore 30. After filling the non-gaseous constituents in the discharge vessel, a pin-like stopper 31 (which is shown in detail in FIG. 4) having a diameter of 0.67 mm is inserted in the filling bore 30 (FIG. 3b). The main part 32 of the stopper is held in the bore by means of an extension part 34 which has a central squeezed or flattened portion 36 (connected to the main part 32) which has a thickness of only 0.3 mm, a length of about 1.5 mm, and a width of 1.0 mm. The rest of the extension part (5 mm long) is similar to the main part. The overall length of the stopper pin 31 is about 11.5 mm. A ring 33 of ceramic sealing material surrounds the extension part 34 and, preferably, also the outer part of the feedthrough or current lead 10 (FIG. 3b).

A weight 39 is applied to the top of the stopper pin 31. It is made from a heavy block of metal (for example, molybdenum) and is fixed in position by means of the feedthrough 10 which fits into a central bore 37 in the weight 39. The weight 39 presses against the upper end of the stopper 31 and thus acts against the outwardly directed pressure which occurs in subsequent manufacturing steps. The assembly shown in FIG. 3b is mounted in a glove-box in an inert gas atmosphere (1 bar), for example, argon or $N_2$. After positioning of the weight 39, the whole assembly is transferred into a separate receptacle connected to the glove-box which is then closed off from the glove-box and evacuated. This means that the inert gas may be evacuated entirely and the desired fill gas (for example, argon or xenon) may be let in. Another possibility is to only reduce the pressure of the inert gas atmosphere (for example, from 1 bar to 0.7 bar) and to directly use it as the fill gas. Nevertheless, in both cases an outwardly directed pressure results because of the narrow gap between the bore and the stopper. A third possibility is to increase the pressure of the inert gas atmosphere to a desired fill pressure of more than 1 bar.

In a further step the ring 33 of sealing material, which has a thickness of about 0.5 to 1 mm, is liquefied by applying heat thereto as symbolized by arrow 38 (FIG. 3b) and runs into the gap. The heating may be carried out by a burner or in a furnace, an increasing filling pressure inside the vessel results during heating. Thus, the use of weight 3a is very helpful to counteract this problem which is inherent to any combination of a filled vessel which is sealed by applying heat.

The distance between the surface 18 of the plug and the weight 39 (FIG. 3b) is preferably at least 5 mm to ensure that the wetting 50 of the pin 10 and/or the stopper 31 takes place far away from the weight 39.

After the liquefied sealing material 33 has run into the gap between the main part 32 of the stopper and the wall of the bore 30, the furnace 38 is removed, the sealed vessel together with the weight 39 is transferred back into the glove-box, and the weight taken away (FIG. 3c). The extension part 34 of the stopper can be severed so as to leave only a small stud of the flattened part 36. The severing of the extension part is very easy because the flattened part is very thin.

Figure 5:
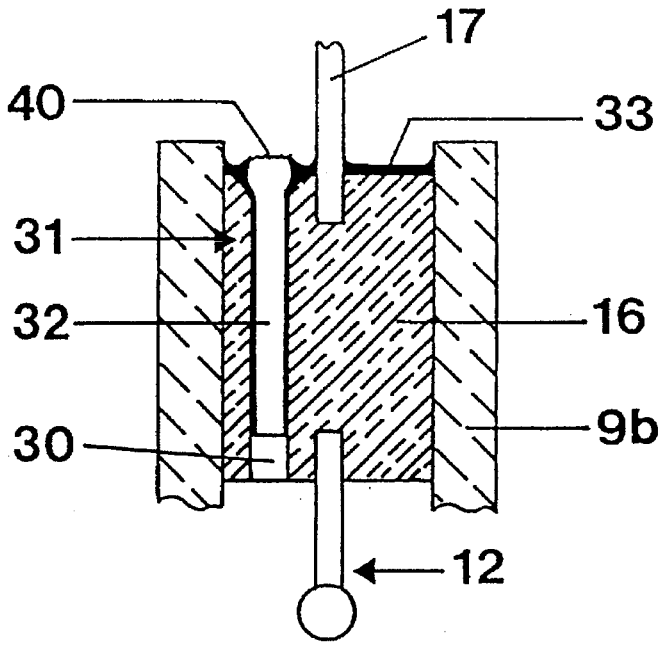
FIG. 5 shows another embodiment of such a discharge vessel end after the final step of closing off the filling bore.

The stud 40 is illustrated by FIG. 5 in which a further embodiment is shown. The configuration at the vessel end 9b is slightly changed by using a plug 16 made from an electrically conductive cermet and a stopper 31 having a shank 32 made from alumina. The plug 16 itself acts as a feedthrough. It connects an electrode 12 with an outer current lead 17.

Various other changes and modifications may be made, and any features described in different embodiments may be used in combination, within the scope of the inventive concept. The length of the main part of the stopper depends on the location of the filling bore and the thickness of the wall or of the plug. Other materials than alumina may be used, for example AlN.

We claim:

1. A discharge vessel (8) for high-pressure discharge lamps defining a discharge volume and having two vessel ends (9*a*, 9*b*);

an ionizable fill within the discharge volume;

two electrode systems (12) within the discharge volume; and a ceramic-type member formed as a plug (11) and providing a current feedthrough which is connected to one of the electrode systems (12) in each of the ends, wherein the plugs (11) at both vessel ends (9*a*, 9*b*) are sintered directly into the vessel and gas-tightly close the vessel ends;

wherein a small filling bore (20; 25; 30) is formed in the region of one (9*b*) of the vessel ends; and wherein the combination of a plug-like member or stopper (21; 26; 31), and sealing material (7*d;* 23, 24) is provided, sealingly closing said filling bore, said sealing material and plug-like member or stopper being so arranged in the combination that a minimum of sealing material is in contact with the fill in the discharge volume.

2. Ceramic discharge vessel as in claim 1, characterised in that the plug and the discharge vessel are made entirely or mainly from alumina.

3. Ceramic discharge vessel as in claim 1, characterised in that the plug (16) is made from cermet material which is electrically conductive.

4. Ceramic discharge vessel as in claim 1, characterised in that the plug (11) is made from electrically non-conductive material and an electrically conductive current feedthrough (10) extends through the plug (11), the feedthrough (10) optionally being a pin-like member.

5. Ceramic discharge vessel as in claim 4, characterised in that the current feedthrough (10) is directly sintered into the plug (11).

6. Ceramic discharge vessel as in claim 1, characterised in that the filling bore (25) is located in wall of the vessel adjacent said one of the vessel ends.

7. Ceramic discharge vessel as in claim 6, characterised in that the length of the stopper (31) inside the filling bore (30) is shorter, optionally more than 20% shorter, than the length of the filling bore.

8. Ceramic discharge vessel as in claim 1, characterised in that the filling bore (20; 30) is located in one (11*b*) of the plugs.

9. Ceramic discharge vessel as in claim 8, characterised in that the length of the stopper (31) inside the filling bore (30) is shorter, optionally more than 20% shorter, than the length of the filling bore.

10. Ceramic discharge vessel in claim 1, characterised in that the stopper is made from ceramic-type material, optionally a material similar to that surrounding the filling bore.

11. Ceramic discharge vessel as in claim 1, characterised in that th stopper has an extension part (28; 34) outside the filling bore (25; 30) which is dimensioned to prevent insertion of the extension part into the filling bore.

12. Ceramic discharge vessel as in claim 11, characterised in that the stopper (31) is pin-like and has a squeezed or flattened part (36) outside the filling bore.

13. Ceramic discharge vessel as in claim 1, characterised in that the fill includes a halogen containing component.

14. Ceramic discharge vessel as in claim 1, characterised in that the outside end portion (35) of the filling bore has an increased diameter.

15. The ceramic discharge vessel as claimed in claim 1, wherein said plug-like member or stopper (21; 26; 31) has a diameter which almost fills said filling bore (20; 25, 30), whereby only said minimum of sealing material (7*d;* 23, 24) will be in contact with the fill in the discharge volume.

16. Method of making a ceramic discharge vessel in accordance with claim 1, characterised by the following steps:

a) providing a discharge vessel in which two plugs have been directly sintered into the two vessel ends, and a filling bore is provided in a second end of the vessel;

b) evacuating and at least partially filling the discharge vessel through the said filling bore with an ionizable fill;

c) inserting a stopper into the filling bore;

d) applying, with said stopper in place in the filling bore, a sealing material to the outer end of the filling bore;

e) applying heat to the region of the second end of the discharge vessel to liquefy the sealing material and gas-tightly close off the filling bore.

17. The method of claim 16, characterised in that a weight is applied to the stopper before step e).

18. The method of claim 17, characterised in that the stopper has an extension part which is long enough to assist during the filling and sealing procedure.

19. The method of claim 18, wherein the extension part is severed after step e) leaving only a stud.

20. The method of claim 16, wherein the filling is accomplished before step e).

21. The method of claim 16, wherein said stopper has a diameter which almost fills the filling bore; and wherein step e) comprises heating only so much of sealing material that, during the heating step, and resulting in a fused combination of said stopper and sealing material sealed in the bore, the sealing material exposed to the interior of the discharge vessel, and hence to said fill, will be a minimum.

* * * * *